US005545054A

United States Patent [19]

Benes et al.

[11] Patent Number: 5,545,054

[45] Date of Patent: Aug. 13, 1996

[54] ELECTRICAL CONNECTOR WITH HINGED COVER

[75] Inventors: Kevin C. Benes, Willowbrook; Fred L. Krehbiel, Chicago; Russell L. Mackowiak, Wheaton, all of Ill.

[73] Assignee: Molex Incorporated, Lisle, Ill.

[21] Appl. No.: 296,766

[22] Filed: Aug. 26, 1994

[51] Int. Cl.[6] ..... H01R 13/58

[52] U.S. Cl. ..... 439/467; 439/465

[58] Field of Search ..... 439/595, 596, 439/599, 452, 467, 460, 341, 465, 466

[56] References Cited

U.S. PATENT DOCUMENTS

| | | | |
|---|---|---|---|
| 4,413,872 | 11/1983 | Rudy, Jr. et al. | 439/467 |
| 4,660,914 | 4/1987 | Nakamura | 339/59 R |
| 4,759,723 | 7/1988 | Siemon | 439/467 |
| 4,867,705 | 9/1989 | Yuasa | 439/595 |
| 4,979,913 | 12/1990 | Aiello et al. | 439/596 |
| 5,037,325 | 8/1991 | Wirkus | 439/467 |
| 5,316,504 | 5/1994 | Jinno | 439/752 |

FOREIGN PATENT DOCUMENTS

| | | | |
|---|---|---|---|
| 4234976A1 | 4/1993 | Germany | H01R 13/436 |
| 4446807A1 | 12/1994 | Germany . | |
| 2260866 | 10/1992 | United Kingdom . | |

*Primary Examiner*—David L. Pirlot
*Attorney, Agent, or Firm*—A. A. Tirva

[57] ABSTRACT

An electrical connector includes a dielectric housing having a through axial passage for receiving therein an electrical terminal. A cover is hingedly connected to the housing for movement from an open position to a closed position, with the cover and the housing having respective juxtaposed walls bounding at least one lateral side of the passage when the cover is in its closed position. Complementary laterally engaging latches are provided between the juxtaposed walls to hold the cover in its closed position. The wall of the cover is juxtaposed inside the wall of the housing in a lateral direction. Therefore, lateral forces on the terminal biases the wall of the cover outwardly toward the wall of the housing to ensure engagement of the laterally engaging latches.

10 Claims, 2 Drawing Sheets

ELECTRICAL CONNECTOR WITH HINGED COVER

FIELD OF THE INVENTION

This invention generally relates to the art of electrical connectors and, particularly, to an electrical connector which has a hinged cover for retaining a terminal within a housing of the connector.

BACKGROUND OF THE INVENTION

Electrical connectors have been provided in a wide variety of designs or configurations. Generally, a typical electrical connector includes a dielectric or insulative housing having one or more passages or cavities for receiving one or more terminals therein. The housing usually has a front or mating end for mating with a complementary connector or other electrical device which has one or more terminals for interconnection with the terminals within the housing. Electrical leads project outwardly of a rear or terminating end of the connector housing. Various systems are provided for securing the terminals within the housing, ranging from interengaging latching means between the terminals and the housings for substantially permanently mounting the terminals within the housings to releasable latching devices which permit ready removal of the terminals from the housings.

In a known electrical connector, a housing is provided with a passage for receiving therein an electrical terminal. The housing substantially encloses the terminal, and the housing is provided with an integrally molded hinged portion or cover which incorporates means for retaining the terminal within the housing. Such connectors are desirable because the terminal can be inserted into the passage of the housing with substantially zero insertion forces, and the cover can be readily hinged to a locked position to secure the terminal within the housing in proper position within the passage. Normally, the cover and the housing include juxtaposed walls with integral latches to hold the cover in a closed position. A problem with such connectors involves preventing the cover from being unlatched when undesirable forces are applied to the terminal, such as pulling on a lead attached to the terminal and exiting the rear end of the housing.

More particularly, with such connectors as described immediately above, lateral forces often are exerted on the lead which is attached to the terminal within the housing. If a large enough lateral force is exerted on the lead outside the housing, the latches between the cover and the housing may be disengaged and allow the terminal to be unintentionally pulled out of the housing. The present invention is directed to solving these problems by providing a unique structural arrangement between the hinged cover and the housing whereby lateral forces on the terminal or lead actually will ensure positive latching of the cover rather than possibly releasing the latches as is prevalent in the prior art.

SUMMARY OF THE INVENTION

An object, therefore, of the invention is to provide a new and improved electrical connector of the character described, particularly including a cover for a connector housing with a new and improved latching arrangement.

In the exemplary embodiment of the invention, an electrical connector includes a dielectric housing having a through axial passage for receiving therein electrical terminal means. A cover is hingedly connected to the housing for movement from an open position to a closed position, with the cover and the housing having respective juxtaposed walls bounding at least one lateral side of the passage when the cover is in its closed position. Complementary laterally interengaging latch means are provided between the juxtaposed walls to hold the cover in its closed position. The invention contemplates that the wall of the cover be juxtaposed inside the wall of the housing in a lateral direction. Therefore, lateral forces on the terminal means biases the wall of the cover outwardly toward the wall of the housing to ensure engagement of the laterally engaging latch means.

As disclosed in the preferred embodiment, the housing includes a pair of axially extending flexible walls bounding opposite sides of the passage. The cover includes a pair of walls respectively juxtaposed inside the walls of the housing on opposite sides of the passage. Specifically, the cover is generally U-shaped in lateral cross-section defining a pair of leg portions joined by a bight portion. The leg portions define the aforementioned walls, and the bight portion bounds a third side of the passage.

The housing and cover are unitarily fabricated of molded plastic material, with the cover hinged to the housing by an integral living hinge means. The pair of walls of the housing comprise axially extending flexible cantilevered arms.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
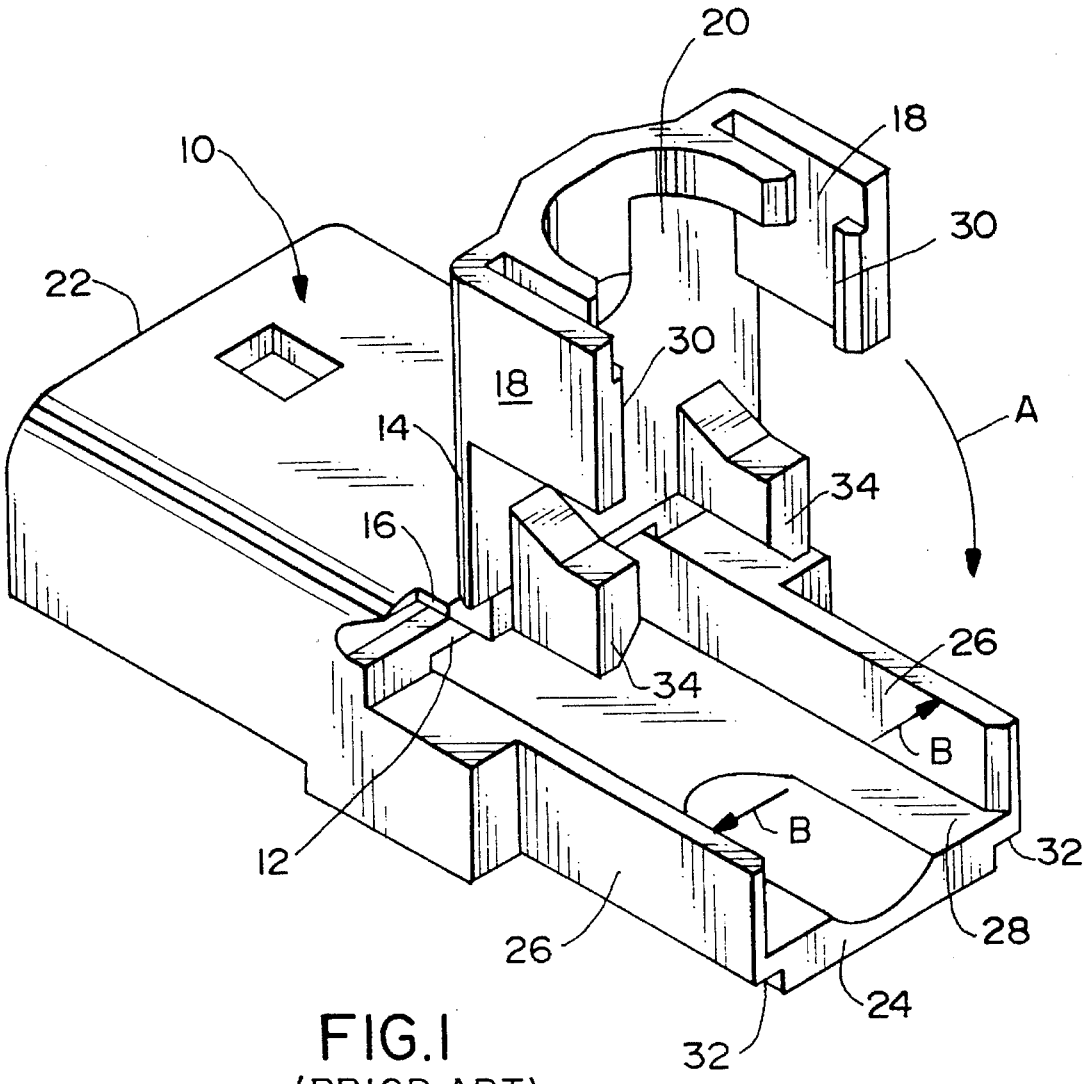
FIG.1 (PRIOR ART)
FIG. 1 is a perspective view of an electrical connector housing according to the prior art, with the hinged cover in open position.

Referring to the drawings in greater detail, and first to FIG. 1, a housing, generally designated 10, of an electrical connector according to the prior art, is shown. The housing is molded of dielectric material and has an axial through passage 12 for receiving therein an electrical terminal (not shown). A cover 14 is hinged to the housing by an integral living hinge 16. The cover is generally U-shaped to define a pair of side leg portions 18 joined by a bight portion 20. The housing defines a front mating end 22 and a rear terminating end 24. As can be seen, the cover is hinged for movement from an open position, as shown, in the direction of arrow "A" to a closed position wherein the cover closes passage 12 at the rear end of the housing.

The rear end 24 of housing 10 is generally U-shaped and includes a pair of side walls 26 integrally joined to a bottom wall 28, whereby the side walls bound opposite sides of passage 12. When cover 14 is moved to its closed position, leg portions 18 move into juxtaposition on the outside of side walls 26. Inside latches 30 of the leg portions snap beneath latch shoulders 32 at the lower ends of side walls 26 to hold the cover in its closed position. A pair of locking bosses 34 engage appropriate shoulders on the terminal to secure the terminal in passage 12 of housing 10 when the cover is closed.

A problem with the prior art connector housing of FIG. 1 resides in the potential for cover 14 to become unlatched in response to lateral forces applied to the terminal within the housing, and particularly forces applied to the lead from the terminal that projects outwardly of passage 12 at rear end 24 of the housing. In particular, if lateral forces are applied in the direction of either of arrows "B" the forces will be applied to the respective side wall 26 of the housing. The side wall, being flexible, will push on the respective leg portion 30 of cover 14, again in the direction of one of arrows "B". With a sufficient force, the side wall actually will push the leg portion 30 sufficiently outwardly to disengage the inside latch 30 from the latch shoulder 32 and release the cover, whereupon the terminal can be pulled out of the housing as the cover is opened by the pulled terminal. The present invention, described below, prevents such inadvertent or undesirable opening of the cover and removal of the terminal.

Figure 2:
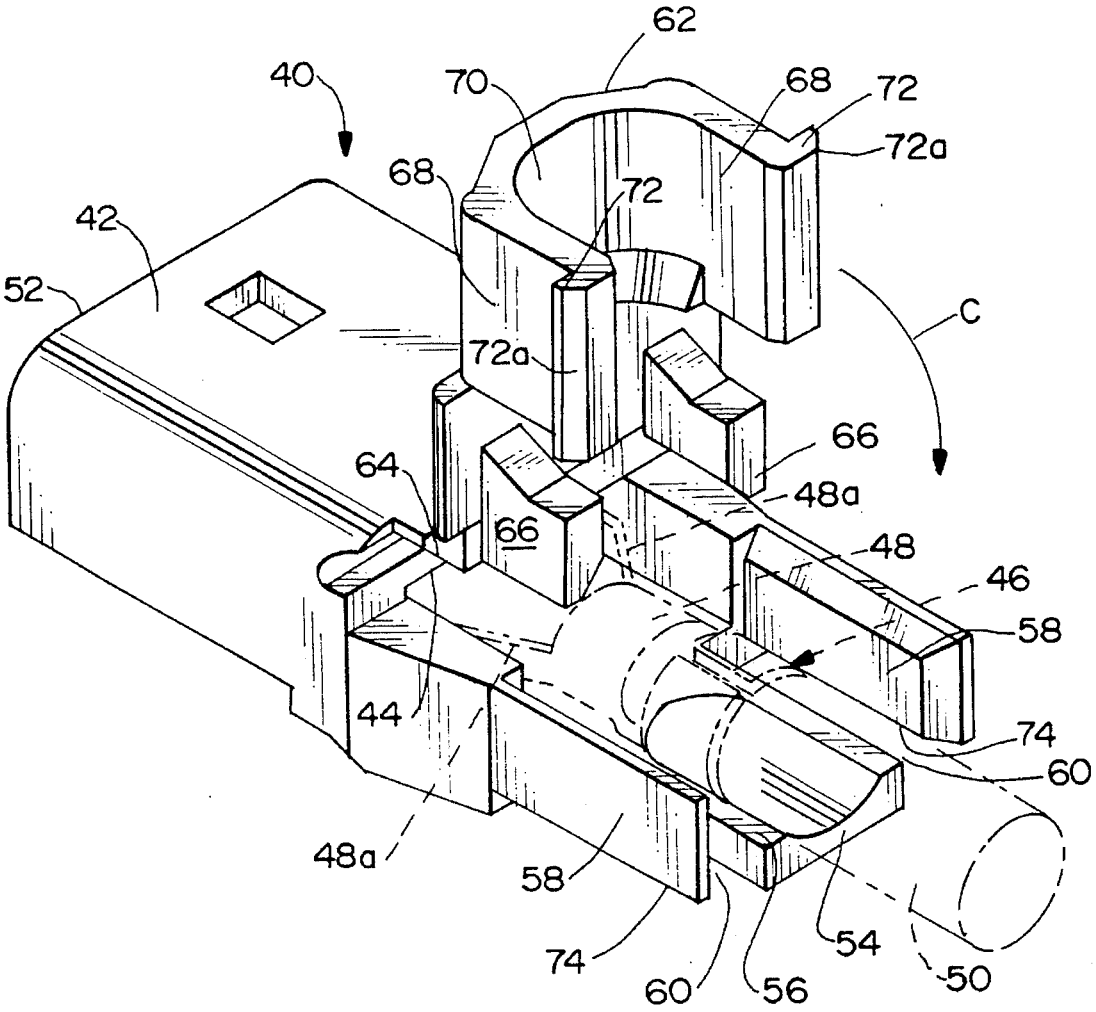
FIG. 2 is a perspective view of an electrical connector according to the present invention, again with the cover in its open position.

Specifically, referring to FIG. 2, an electrical connector, generally designated 40, is shown according to the present invention. The connector includes a dielectric housing, generally designated 42, having a through axial passage 44 for receiving an electrical terminal means, generally designated 46 and shown in phantom. The terminal means includes a terminal 48 connected to a lead 50, the terminal having rearwardly facing shoulders 48*a*.

Housing 42 defines a front mating end 52 and a rear terminating end 54. The rear end is defined by a generally rigid tongue-like bottom wall 56 and a pair of side walls 58 that are separated from bottom wall 54 by gaps 60. In essence, side walls 58 comprise axially extending, flexible cantilevered arms or beams. The side walls bound opposite sides of passage 44 at the rear end of housing 42, and bottom wall 56 bounds the bottom of the passage.

A cover, generally designated 62, is hinged to housing 42 by an integral living hinge means 64. The housing and cover are unitarily fabricated of molded plastic material, with living hinge means 64 being integral therebetween. The cover is pivotally movable about the hinge means from an open position, as shown, in the direction of arrow "C" to a closed position. In the closed position, locking bosses 66 engage shoulders 48*a* of terminal 48 to secure the terminal in proper position within passage 44 of housing 42.

Cover 62 is generally U-shaped in lateral cross-section to define a pair of leg portions or walls 68 joined by a bight portion 70. In the closed position of the cover, bight portion 70 defines the top wall of passage 44, opposite bottom wall 56 at rear end 54 of the housing. Leg portions 68 move to positions juxtaposed inside side walls 58 of the housing. The leg portions include laterally outwardly extending flanges or lips 72 which define latches for latchingly engaging bottom latch shoulders or edges 74 of side walls 58. Latching flanges 72 are chamfered, as at 72*a*, for engaging the top edges of side walls 58 to bias the side walls outwardly and/or to bias leg portions 68 inwardly when the cover is pivoted downwardly in the direction of arrow "C" to its closed position. When the cover is closed, latching flanges 72 of cover 62 will snap outwardly into latching engagement with bottom edges 74 of side walls 58.

With the above-described structural arrangement of housing 42 and cover 62 of connector 40 according to the invention, it can be understood that lateral forces on lead 50 and/or terminal 48 will cause the lead or terminal to move laterally outwardly into engagement with leg portions 68 of cover 62, because the leg portions are juxtaposed inside side walls 58 of housing 42. Therefore, any movement of leg portions 68 will cause latching shoulders 72 to move more firmly into latching engagement beneath bottom edges 74 of side walls 58. In other words, rather than tending to open the latch means between the cover and the housing as is prevalent with the prior art connector constructions, the latching means of connector 40, according to the present invention, are more firmly secured to ensure engagement of the laterally engaging latch means should excessive forces be applied to the terminal and/or its lead.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes a dielectric housing having a through axial passage for receiving therein electrical terminal means, a cover hingedly connected to the housing for movement from an open position to a closed position with the cover and the housing having respective juxtaposed walls bounding at least one lateral side of the passage when the cover is in its closed position, said juxtaposed walls each having a top edge and a bottom edge, and complementary laterally interengaging latch means between the juxtaposed walls to hold the cover in its closed position, wherein the improvement comprises the wall of the cover being juxtaposed inside the wall of the housing in a lateral direction and said latch means interengaging between said respective bottom edges of said juxtaposed walls when the cover is in its closed position, whereby lateral forces on the terminal means biases the wall of the cover outwardly toward the wall of the housing to ensure engagement of the laterally engaging latch means.

2. In an electrical connector as set forth in claim 1, wherein said wall of the housing comprises an axially extending flexible arm.

3. In an electrical connector as set forth in claim 1, wherein said housing and cover are fabricated of plastic material and said juxtaposed walls are generally flexible.

4. In an electrical connector as set forth in claim 1, wherein said housing includes a pair of said walls bounding opposite sides of the passage, and the cover includes a pair of walls respectively juxtaposed inside the walls of the housing on opposite sides of the passage.

5. In an electrical connector as set forth in claim 4, wherein said cover is generally U-shaped in lateral cross-section defining a pair of leg portions joined by a bight portion, the leg portions defining said walls and the bight portion bounding a third side of the passage.

6. In an electrical connector as set forth in claim 4, wherein said housing and cover are unitarily fabricated of molded plastic material with the cover hinged to the housing by an integral living hinge means.

7. In an electrical connector as set forth in claim 4, wherein said pair of walls of the housing comprise axially extending flexible cantilevered arms.

8. An electrical connector, comprising:

a housing of molded dielectric plastic material having an axially extending through passage adapted to receive an electrical terminal therein with a lead projecting from the terminal out of a rear end of the housing, the housing including a pair of side walls bounding opposite sides of the passage at the rear end of the housing, said side walls each having a top edge and a bottom edge;

a cover hingedly connected to the housing for movement from an open position to a closed position, the cover being generally U-shaped in lateral cross-section to define a pair of leg portions joined by a bight portion, each of said leg portions terminating at a bottom edge and being juxtaposed inside the side walls of the housing on respective opposite sides of the passage when the cover is in its closed position, and the bight portion bounding a third side of the passage; and complementary laterally interengaging latch means for interengagement between the bottom edge of one of said side walls of the housing and the bottom edge of one of said leg portions of the cover for holding the cover in its closed position, whereby lateral forces on the terminal, such as by pulling on the lead, biases leg portions of the cover outwardly toward the side walls of the housing to ensure engagement of the laterally engaging latch means.

9. The electrical connector of claim 8 wherein said side walls of the housing comprise axially extending flexible arms.

10. The electrical connector of claim 8 wherein said cover is hinged to the housing by an integral living hinge means.

* * * * *